US011315401B2

(12) United States Patent
Gulick, Jr. et al.

(10) Patent No.: US 11,315,401 B2
(45) Date of Patent: Apr. 26, 2022

(54) POWERED SECURITY APPARATUS

(71) Applicant: Scorpion Security Products, Inc., Vestal, NY (US)

(72) Inventors: Franklyn W. Gulick, Jr., Vestal, NY (US); Gary R. Page, Chenango Forks, NY (US); Patrick McEwen, Greene, NY (US); Andrew Bartoszewski, Syracuse, NY (US)

(73) Assignee: Scorpion Security Products, Inc., Vestal, NY (US)

( * ) Notice: Subject to any disclaimer, the term of this patent is extended or adjusted under 35 U.S.C. 154(b) by 0 days.

(21) Appl. No.: 17/333,318

(22) Filed: May 28, 2021

(65) Prior Publication Data

US 2021/0375110 A1 Dec. 2, 2021

Related U.S. Application Data

(60) Provisional application No. 63/031,047, filed on May 28, 2020.

(51) Int. Cl.
*G08B 13/24* (2006.01)

(52) U.S. Cl.
CPC ..... *G08B 13/2434* (2013.01); *G08B 13/2417* (2013.01); *G08B 13/2454* (2013.01)

(58) Field of Classification Search
CPC ..... G08B 13/2434
See application file for complete search history.

(56) References Cited

U.S. PATENT DOCUMENTS 8,952,816 B2 * 2/2015 Sayegh ..... E05B 73/0017 340/572.8
2011/0140895 A1 * 6/2011 Sayegh ..... E05B 73/0017 340/572.8

* cited by examiner

*Primary Examiner* — Travis R Hunnings
(74) *Attorney, Agent, or Firm* — Barclay Damon LLP

(57) ABSTRACT

A security apparatus comprises a body comprising a first guide and a second guide extending along a guide axis and positioned at opposing side of the body, a first holder moveably coupled to the first guide, and a second holder moveably coupled to the second guide. The security apparatus further comprises an actuator, and at least one driver operatively coupled to the actuator and positioned along the guide axis. The driver is connected to the first holder and the second holder. A controller is in communication with the actuator and comprises a controller input, wherein in response to an authorized input, the actuator is configured to drive the driver to move the first holder along the first guide and to move the second holder along the second guide.

16 Claims, 6 Drawing Sheets

POWERED SECURITY APPARATUS

CROSS-REFERENCE TO RELATED APPLICATIONS

This non-provisional application claims the benefit and priority of U.S. provisional application Ser. No. 63/031,047, filed on May 28, 2020. The entire contents of said application is hereby incorporated by reference.

TECHNOLOGICAL FIELD

This invention relates to a powered security device configured to hold a portable electronic device and which allows for the functional and secure display of the portable or handheld electronic device.

BACKGROUND

Retailers sell a wide range of portable or hand held electronic devices that can assist in or perform a multitude of tasks for the a user or customer. Part of the purchasing experience is having the ability to examine and test the device. This is done using floor models that are fitted with some form of security apparatus to prevent theft of the device. However, accurately testing the comfort, weight, and ability to use a hand held device while the security apparatus is in place is impossible.

Some security apparatuses do not allow a customer to pick up the electronic device without it being attached or tethered to the security apparatus, which severely limits the customer's ability to test the electronic device. Other security apparatuses comprise a fixed portion that remains coupled to the display surface and a second portion coupled to the electronic device. These security apparatuses allow the customer to freely hold the electronic device however the second portion of the security apparatus remains attached, making it difficult to hold the electronic device and causing the electronic device to weigh more than it should.

In addition, some currently used security apparatuses have an alarm sensor that is attached to a portion of the handheld electronic device using an adhesive or tape. The sensor is activated when it loses contact with the handheld device and alerts store employees of possible theft. However, these tapes and adhesives often fail during use resulting in the alarm losing contact with the handheld electronic device and a false alarm to sound, which can startle customers and waste employee time responding to said false alarms.

These are just some of the problems associated with current security apparatuses for handheld or portable electronic devices.

SUMMARY

An embodiment of a security apparatus comprises a housing comprising a top surface, and a body at least partially positioned within the housing and comprising a first guide and a second guide extending along a guide axis and positioned at opposing sides of the body. A first holder is moveably coupled to the first guide, and a second holder is moveably coupled to the second guide. A third guide extends from the body and intersects the guide axis. The third guide comprises a plurality of surface features. A support is moveably coupled to the third guide and includes a lock assembly. In a locked state, the support is enabled to move in a first direction along the third guide, and in an unlocked state, the support is further enabled to also move in a second direction along the third guide, wherein the first direction is towards the body and the second direction is away from the body. The security apparatus further comprises an actuator and at least one driver operatively coupled to the actuator and positioned along the guide axis. The driver is connected to the first holder and the second holder. A controller is in communication with the actuator and comprises a controller input. In response to an authorized input, the actuator is configured to drive the driver to move the first holder along the first guide and to move the second holder along the second guide.

In an embodiment, the security apparatus further comprises at least one sensor positioned on the top surface of the housing. In an embodiment, the security apparatus further comprises an alarm in communication with the at least one sensor. In another embodiment, the controller input is configured to receive one of an RFID card, a Bluetooth® key, and a biometric input. Another embodiment of the security apparatus further comprises one or more anti-skid pads positioned on the top surface of the housing. Another embodiment of the security apparatus comprises an alarm disablement device. In an embodiment, the alarm and controller components including the input interface are at least partially surrounded by the housing of the security apparatus.

Another embodiment of the security apparatus comprises a body comprising a first guide and a second guide extending along a guide axis and positioned at opposing side of the body. A first holder is moveably coupled to the first guide and a second holder is moveably coupled to the second guide. The security apparatus further comprises an actuator and at least one driver operatively coupled to the actuator and positioned along the guide axis. The driver is connected to the first holder and the second holder. A controller is in communication with the actuator and comprises a controller input. The actuator is configured to drive the driver in response to an authorized input in order to move the first holder along the first guide and to move the second holder along the second guide.

In an embodiment, the security apparatus further comprises a third guide extending from the body and intersecting the guide axis, wherein the third guide comprises a plurality of surface features, and a support moveably coupled to the third guide and including a lock assembly. When in a locked state, the support is enabled to move in a first direction along the third guide, and when in an unlocked state, the support is further enabled to also move in a second direction along the third guide. The first direction is towards the body and the second direction is away from the body. In an embodiment, the security apparatus further comprises a housing comprising a top surface and configured to at least partially surround the body. In an embodiment, the security apparatus further comprises at least one sensor positioned on the top surface of the housing. In an embodiment, the security apparatus further comprises an alarm in communication with the at least one sensor. In another embodiment, the controller input is configured to receive one of an RFID card, a Bluetooth® key, and a biometric input. In another embodiment, the security apparatus further comprises one or more anti-skid pads positioned on the top surface of the housing. In an embodiment, the security apparatus further comprises an alarm disablement device. In another embodiment, the security apparatus further comprises one or more battery cells in electrical communication with the actuator. In an embodiment, the alarm and controller components including the input interface are at least partially surrounded by the housing of the security apparatus.

An embodiment of a security system for a portable electronic device comprises at least one security apparatus in communication with a central control unit. The at least one security apparatus comprises a body comprising a first guide and a second guide extending along a guide axis and positioned at opposing side of the body, a first holder moveably coupled to the first guide, and a second holder moveably coupled to the second guide. The at least one security apparatus further comprises an actuator, at least one driver operatively coupled to the actuator and positioned along the guide axis, wherein the driver is connected to the first holder and the second holder, and a controller in communication with the actuator and comprising a controller input. The central control unit is positioned away from the at least one security apparatus and is configured to recognize an authorized input at the controller input. In response to the authorized input, the central control unit is configured to transmit a signal to activate the actuator to drive the driver to move the first holder along the first guide and to move the second holder along the second guide.

BRIEF DESCRIPTION OF DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

Figure 1:
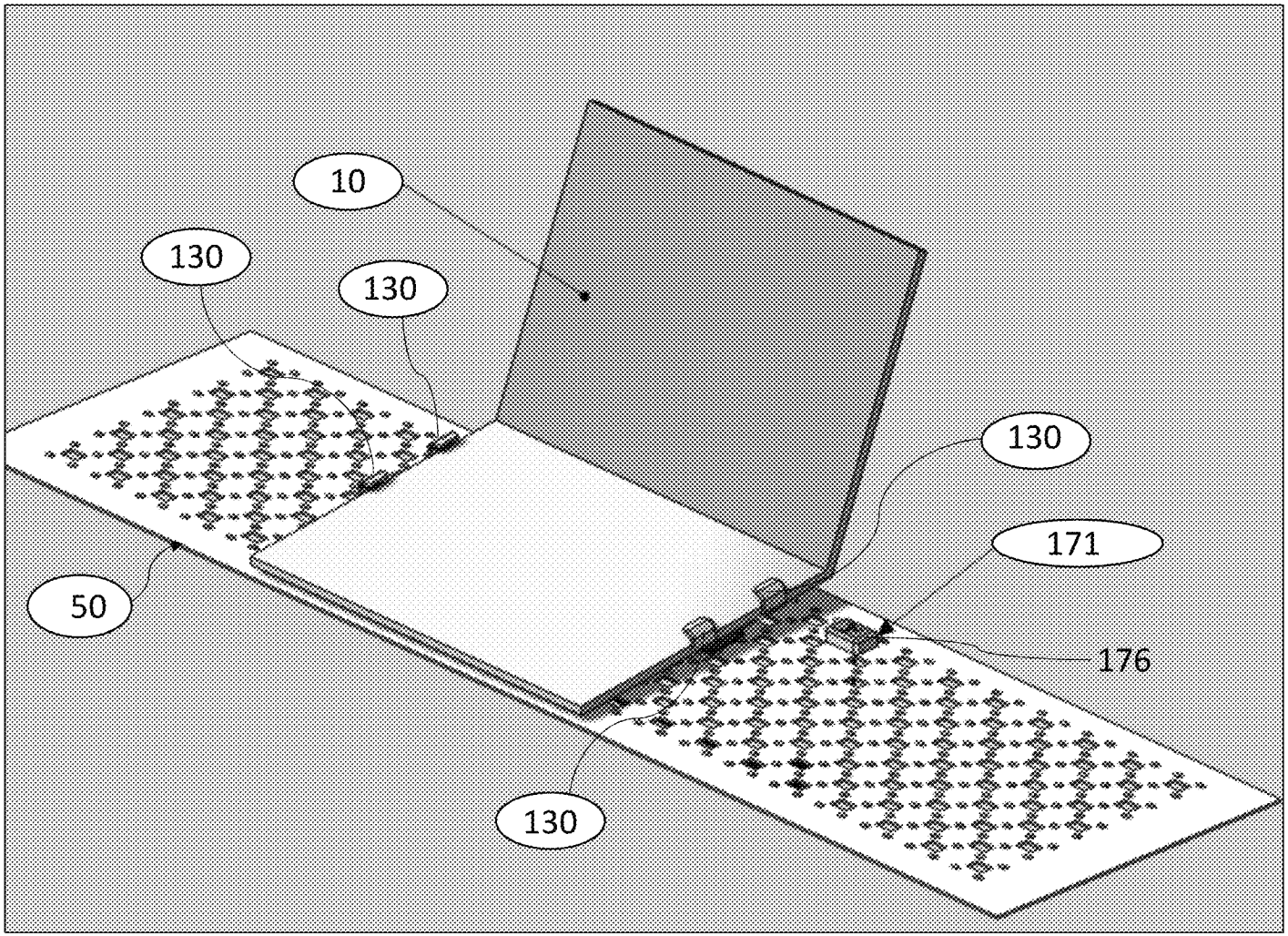
FIG. 1 illustrates a perspective view of an embodiment of a powered security apparatus securing a portable electronic device to a display surface.

The following description relates to various embodiments of the powered security apparatus. It will be readily apparent that these embodiments are merely examples and that numerous variations and modifications are possible that embody the inventive aspects discussed herein. Several terms are used throughout this description to describe the salient features of the invention in conjunction with the accompanying figures. These terms, which may include "first", "second", "inner", "outer", and the like are not intended to overly limit the scope of the invention, unless so specifically indicated. The terms "about" or "approximately" as used herein may refer to a range of 80%-125% of the claimed or disclosed value. It is to be understood that the terms "in communication" or "in electrical communication" may refer to a hard wire connection between components or a wireless communication connection between components. With regard to the drawings, their purpose is to depict salient features of the powered security apparatus and are not specifically provided to scale.

Referring generally to FIGS. 1-5, a powered security apparatus or security apparatus 100 may generally comprise a housing 110 configured to at least partially surround a main body 118. A plurality of guides 112*a*, 112*b* are configured to extend from a main body 118 and may extend away from the housing 110. The housing 110 includes a top surface 113 and is configured to be mounted to a display fixture 50 using couplers 160 attached to the coupling extensions 114 (FIG. 2) extending from the housing 110. The coupling extensions 114 (FIG. 2) may be formed as a single unit with the housing 110 or otherwise permanently affixed to the housing 110. The housing may further define an opposing bottom surface 115 that contacts the display fixture 50 when the housing is mounted to the display fixture 50. In another embodiment, the housing 110 may be at least partially open at a bottom and/or the bottom surface 115 may define one or more openings. The one or more openings may enable easy access to internal components of the powered security apparatus 100 when it is not mounted to the display fixture 50.

Figure 2:
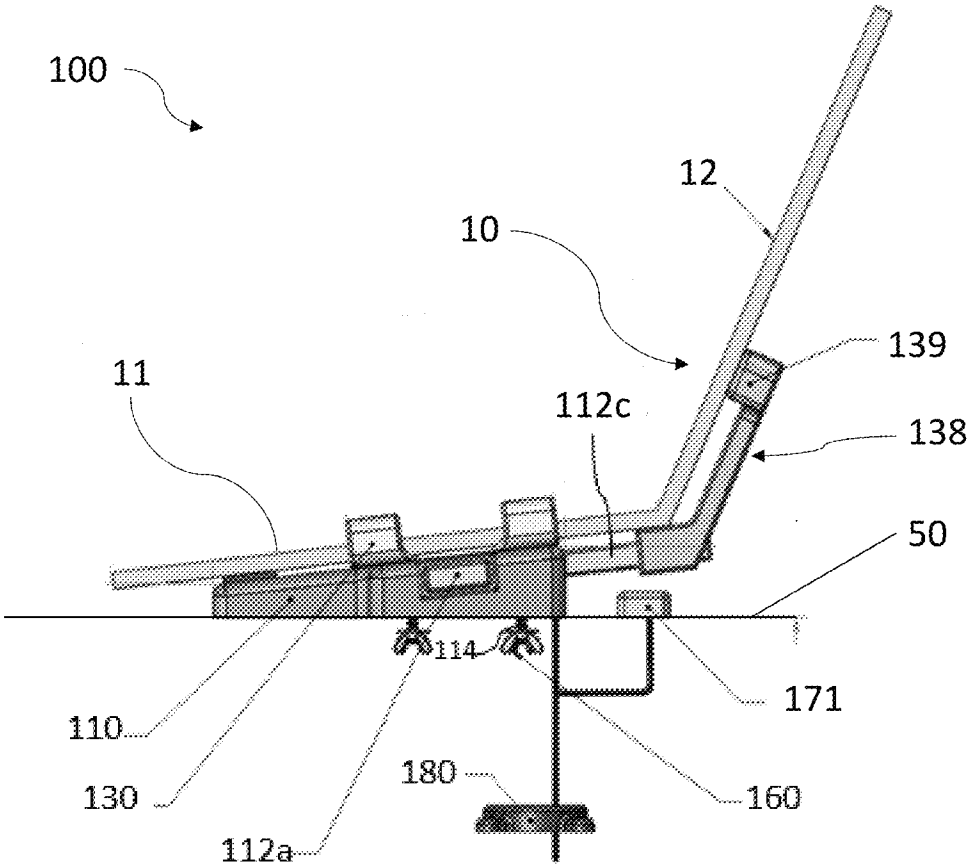
FIG. 2 illustrates a perspective view of the powered security apparatus of FIG. 1 not securing a portable electronic device.
Figure 3:
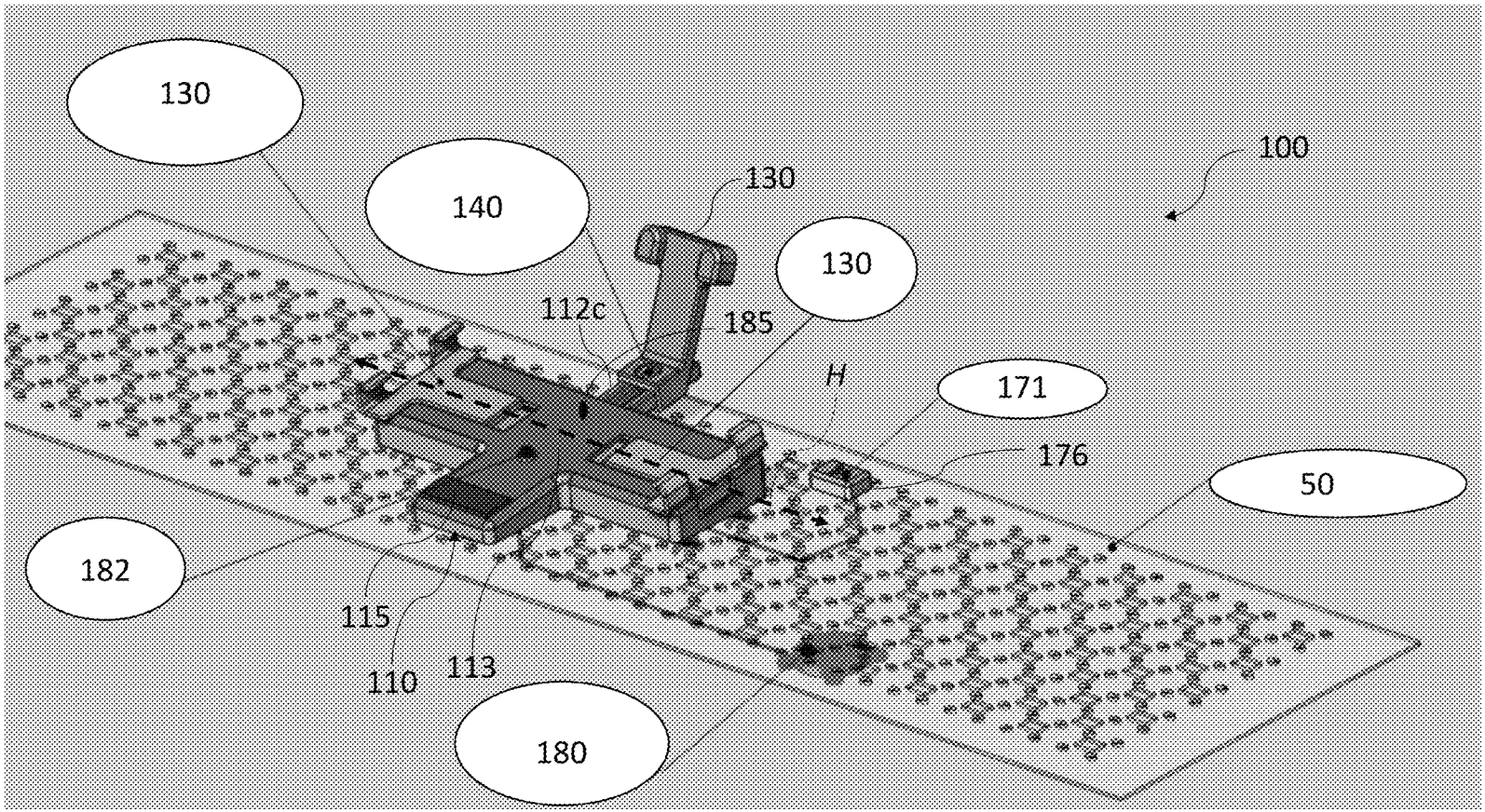
FIG. 3 illustrates a side elevational view of the powered security device of FIG. 1.
Figure 4:
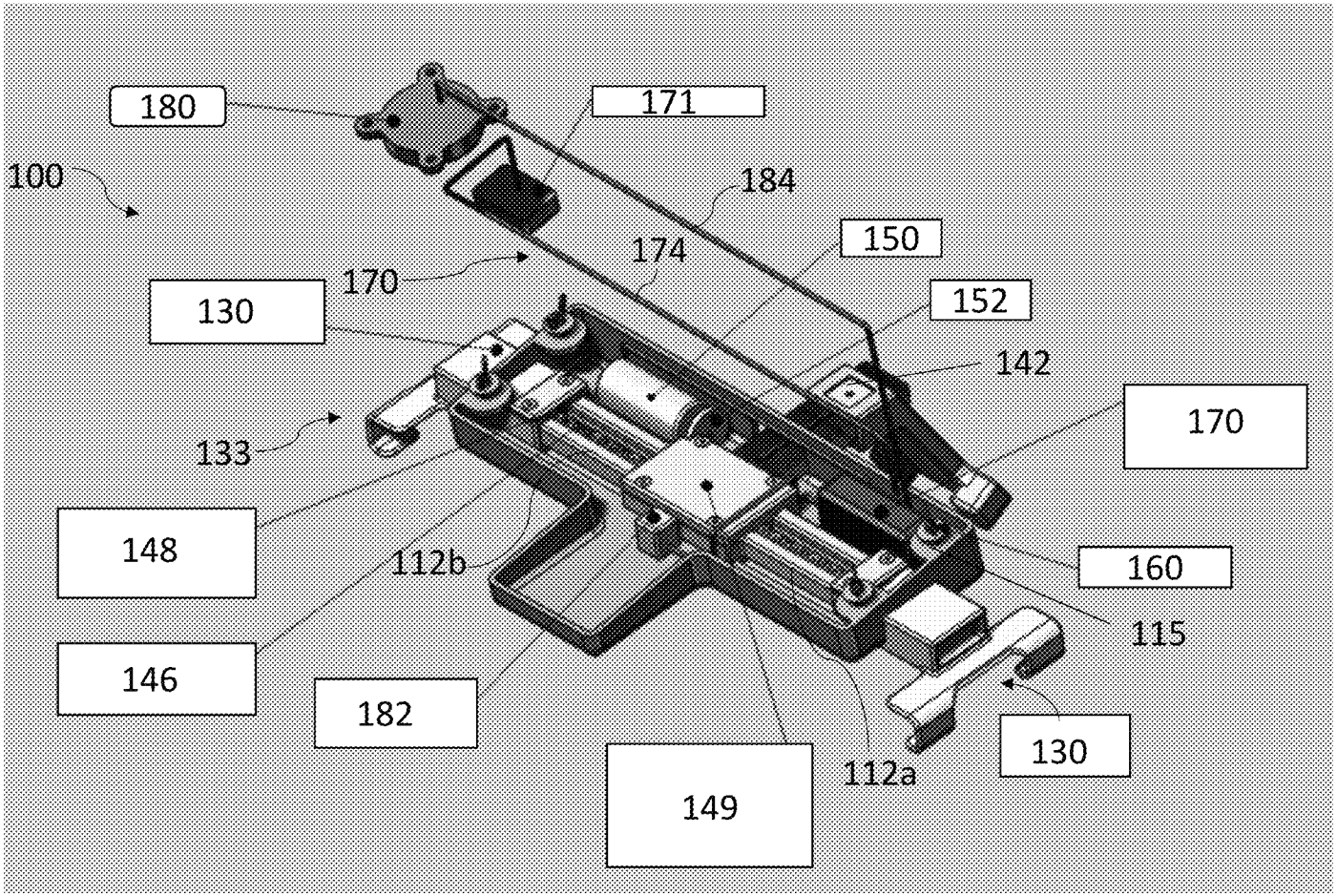
FIG. 4 illustrates a bottom perspective view of an embodiment of the powered security apparatus.
Figure 5:
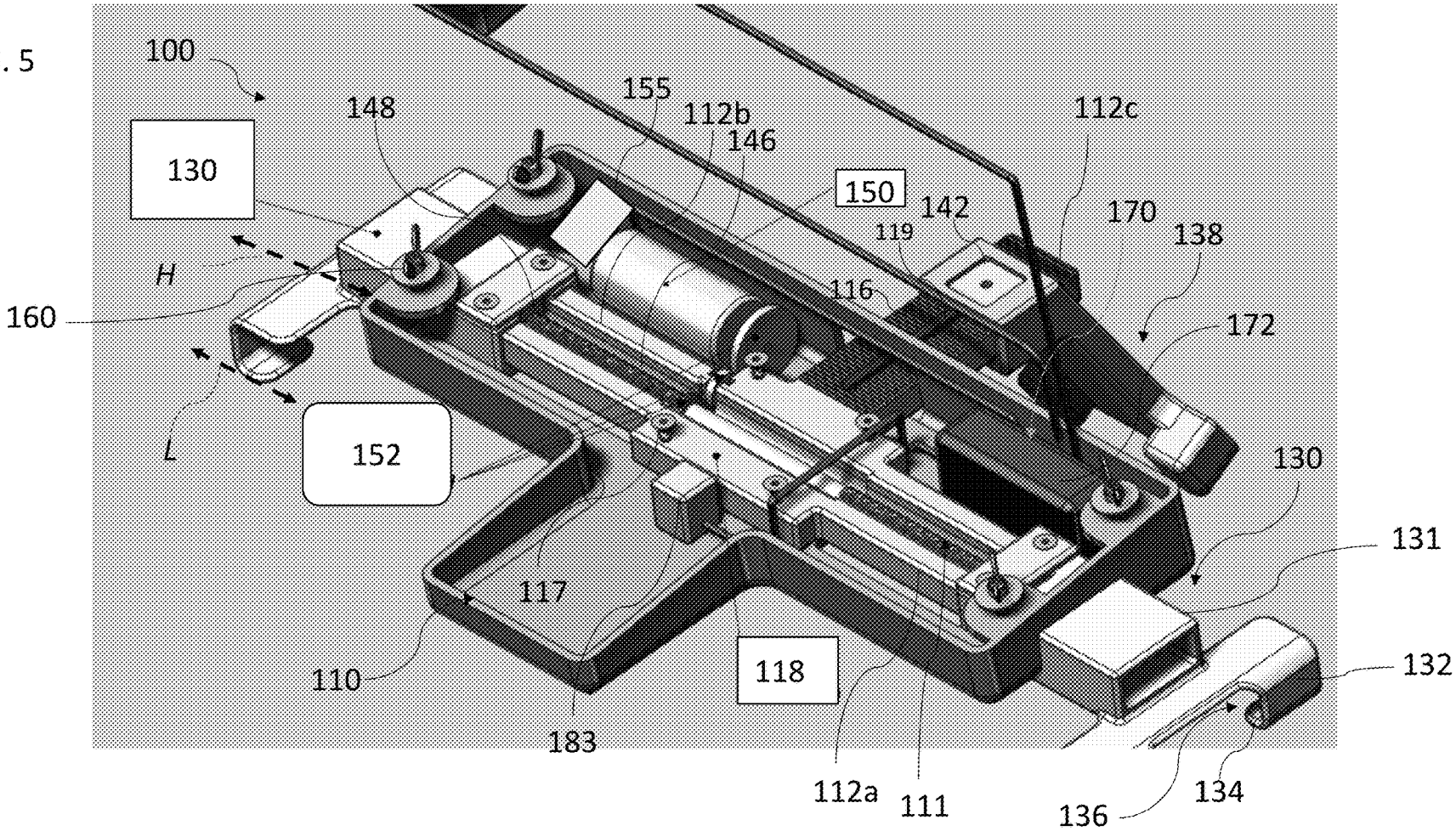
FIG. 5 illustrates a close-up view of the powered security apparatus of FIG. 4.

As shown in the illustrated embodiments, the powered security apparatus 100 may comprise three (3) guides 112*a*, 112*b*, 112*c* however other embodiments may comprise fewer or more guides in order to accommodate specific portable electronic devices 10. The guides 112*a* are each configured to slidably couple to a holder 130 comprising a holder extension 131 extending along a holder plane H (FIGS. 3 and 5). As illustrated in FIGS. 4 and 5, each holder 130 includes a distal holder portion 133 comprising a vertical holder surface 132 extending from main holder extension 131 along an axis that traverses the holder plane H. A lip 134 extends from the vertical holder surface 132 at an end opposite the end of the vertical holder surface 132 that is coupled to the main holder extension 131. Still referring to FIG. 5, the lip 134 extends along a lip plane L that may be substantially parallel to the holder plane H such that a securing pocket 136 is defined between the holder plane H and the lip plane L and is bounded by the main holder extension 131, the vertical holder surface 132, and the lip 134. In the embodiments shown, a support 138 is slidably coupled to the third guide 112*c*. As shown in FIG. 2, the support 138 may comprise one or more support members 139 that extend from the support 138. However, other embodiments of the powered security apparatus 100 may include an additional holder 130 slidably coupled to the third guide 112*b* instead of the support 138.

Referring to FIGS. 4 and 5, two (2) of the guides 112*a*, 112*b* as shown as extending from opposing sides of the main body 118 and the third guide 112*c* extends from a third side of the main body 118 that is adjacent to the opposing sides. The holders 130 and the support 138 may be configured to at least partially surround the guides 112*a*, 112*b*, and 112*c*. The third guide 112*c* may define an elongated opening 119 traversing the third guide 112*b* and a plurality of surface features 116 formed in a bottom surface of the third guide 112*b*. A lock assembly may be fitted to the support 138 and configured to lockably couple to the support 138 to the third guide 112*c*. The locking assembly may include a depression plate 140 coupled to a locking plate 142 through the elongated opening 119. Depression of the depression plate 140 may act to unlock the locking assembly and cause the locking plate 142 to disengage from the surface features 116. Disengagement of the surface features 116 from the locking plate 142 enables the support 138 to be slid or otherwise moved along the third guide 112*c* in a first direction and a second direction that is opposite the first direction. Release of the depression plate 140 causes the locking plate 142 to engage the surface features 116 and lock the locking assembly. In the locked state, the support 138 is inhibited from sliding or moving relative to the third guide 112*c* in at least one of the first direction or the second direction. For example, in an embodiment, the support 138 is inhibited from moving relative to the third guide 112*c* in a direction away from the housing 110 of the powered security apparatus 100. The lock assembly may further include a resilient member, such as a spring, that biases the depression plate 140 and the locking plate 142 such that the resting state of the lock assembly is the locked state where the locking plate 142 engages the surface features 116 of the third guide 112*c*.

The first and second guides 112*a* and the main body 118 define a channel 111 as shown in FIG. 5. The channel 111 extends along the main body 118 and generally between two areas proximate the holders 130. A driver 146 is positioned in the channel 111 and comprises a first end and an opposing second end. The first and second ends are rotatably coupled to opposing holders 130 via a driver engager 148. As shown in FIG. 4, a portion of the channel 111 may be covered with a covering 149 such as a plate, which may aid in retaining the driver 146 within the channel 111. The covering 149, as well as other components within the housing 110, may be held in place or otherwise fixed or coupled to the housing 110 or each other using one or more couplers 117. An actuator 150 is positioned within the housing 110 and operatively coupled to the driver 146 by a force transmission assembly 152 configured to transfer a force generated by the actuator 150 to the driver 146. Movement of the driver 146 moves the holders 130 together in opposing directions. For example, movement of the driver 146 in a first direction acts to drive the holders 130 away from each other and movement of the driver 146 in a second direction acts to drive the holders 130 towards each other. As shown, the force transmission assembly 152 may comprise one or more gears configured to be rotated by the actuator 150. Rotation of the one or more gears may further act to rotate the driver 146. The actuator 150 may be powered using an electrical current supplied by an electrical outlet, one or more battery cells 155 (FIG. 5), or any other suitable means of reliably supplying an electrical current.

A controller 170 is in electrical communication the actuator 150 and configured to control the actuator though a user input. The controller 170 may comprise a controller housing 172 positioned within the housing 110 and configured to at least partially surround components of the controller 170, such as a reader, a processor, and a memory unit. A controller input 171 with an input interface 176 is coupled to the processor through a communication link 174. In an embodiment, the controller input 171 may be a separate unit positioned outside the housing 110 and including an input interface. In other embodiments, the controller 170, the controller input 171, and the input interface 176 are positioned at least partially within the housing 110. In another embodiment, the controller 170, controller input 171 and input interface 176 may be a single unit that is at least partially enclosed by the housing 110. In this embodiment, the input interface 176 may be accessible through the housing 110 or positioned on the housing 110. The controller 170 may be a radio frequency identification (RFID) unit with an input interface 176 that is configured to read an RFID card. In another embodiment, the controller 170 may be a biometric unit with an input interface 176 that is configured to read a biometric input provided by a user (e.g., finger print or retinal scan). In another embodiment, the controller 170 and/or the input interface 176 may include a Bluetooth® receiver. In this embodiment, the powered security apparatus 100 may be controlled using a smart phone or Bluetooth® key. In other embodiments, the powered security apparatus 100 may be controlled using a combination of mechanical and wireless systems.

One or more sensors 182 may be positioned on the housing 110 and specifically on the top surface 113 of the housing 110. The one or more sensors 182 may be in communication with an alarm 180 via an alarm communications link 184. As shown, the alarm communications link 184 is a hard wire connection between the one or more sensors 182 and the alarm 180, however in other embodiments the alarm communications link may be a wireless link. In the embodiments shown, the alarm 180 may be remote from the housing 110 of the powered security apparatus 100, however in other embodiments, the alarm 180 may be at least partially positioned within the housing 110 of the powered security apparatus 100. The alarm 180 may comprise an alarm housing 183 (FIG. 5) configured to at least partially surround components of the alarm 180. The alarm 180 may produce an audible noise and/or visual indication that it has been triggered. In still another embodiment, the powered security apparatus 100 may include a remote alarm as well as an alarm within the housing 110.

The one or more sensors 182 may comprise a pressure sensor, an optical sensor (e.g., photo sensor or motion sensor), temperature, or any other sensor or combination of sensors appropriate for sensing the presence (and absence) of a portable electronic device 10 being secured by the powered security apparatus 100. The one or more sensors 182 may further be able to detect tampering of or a malfunction of the powered security apparatus 100. In an embodiment, the one or more sensors 182 include a pressure sensor that may comprise a push button configured to be held in a depressed position when the portable electronic device 10 is placed on the top surface 113 of the housing 110. When the portable electronic device 10 is removed from the top surface 113 of the housing 110, the push button releases and the alarm is triggered. The powered security apparatus 100 may be used in conjunction with a supplemental wireless monitoring system uploaded to the portable electronic device 10 itself as is described in U.S. Pat. No. 10,708,785.

To secure a portable electronic device 10 in the powered security apparatus 100, the user provides an authorized input to the input interface. The authorized input may be an RFID card, a biometric input, a Bluetooth® key, a manually input code, or any other suitable type of input. Once the input is verified as being an authorized input, the actuator 150 is triggered to move the driver 146 such that the holders 130 are driven away from each other. The depression plate 140 of the push button lock assembly is then manually depressed and the support 138 is moved in a direction away from the housing 110. The powered security apparatus 100 is now ready to accept a portable electronic device 10. As shown in FIGS. 1 and 2, the portable electronic device 10 is a laptop computer or laptop, however the powered security apparatus 100 may be sized and shaped in order to accommodate any other type portable electronic device 10 such as a smart phone, a tablet, a gaming system, or any other portable electronic device 10.

The laptop 10 is then placed on the top surface 113 of the housing 110 such that the laptop 10 covers the sensor 182. The user again provides an authorized input to the input interface, which triggers the actuator 150 to drive the driver 146 such that the holders 130 move towards each other. As the holders 130 move towards each other they trap a portion of the laptop 10 within the pocket 136 of each holder 130. As this is done, the laptop 10 self-centers on the top surface 113 of the housing 110. One or more anti-skid pads 115 may be placed on the top surface 113 of the housing 110 to inhibit sliding of the laptop 10 relative to top surface 113 of the housing 110. The actuator 150 is further equipped with a torque or tension setting to ensure that the holders 130 are not over tightened onto the laptop 10. The tension setting enables the user to adjust the tension or pressure applied to the portable electronic device 10 by the holders 130 when the powered security apparatus 100 is securing a portable electronic device 10. In an embodiment, the tension setting may be adjusted at a tension setting interface accessible through the housing 110 such that the tension may be adjusted when the powered security apparatus 100 is coupled to a display fixture 50. Once the keyboard 11 of the laptop 10 is secured between the holders 130, the actuator 150 automatically stops. The support 138 is then moved towards the housing 110 such that it contacts and supports the back of the laptop screen 12. Moving the support 138 closer to the housing 110 positions the depression plate 140 under the laptop 10, making it inaccessible when the powered security apparatus 100 is securing a portable electronic device such as a laptop computer 10. The laptop 10 is now securely held by the powered security apparatus 100. At this point, the powered security apparatus 100 may be coupled to the display fixture 50, or the powered security apparatus 100 may be coupled to the display fixture 50 prior to securing the portable electronic device.

In order to remove the portable electronic device 10, in this case the laptop from the powered security apparatus 100, the user must provide an authorized input to the input interface. The authorized input triggers the actuator 150 to drive the driver 146 such that the holders 130 move away from each other. The laptop 10 may then be lifted from the powered security apparatus 100 thereby uncovering the sensor 182. Uncovering the sensor 182 will trigger the alarm 180. In an embodiment, providing an authorized input to the input interface may act to disable the alarm 180. If the sensor is a pressure sensor, then removing the laptop 10 will eliminate the pressure detected by the sensor and will trigger the alarm. If the sensor is an optical sensor, then removing the laptop 10 from the powered security apparatus 100 will break the optical signal, or in the case of a photo sensor, will expose the sensor 182 to an increased amount of light and trigger the alarm 180. In an embodiment, multiple consecutive unauthorized inputs may also trigger the alarm 180. For example, the repeated use of a deactivated RFID card would trigger the alarm 180. In another embodiment, component malfunction may also trigger the alarm. The powered security apparatus 100 may further include an alarm disablement device or switch 185 (FIG. 3). The alarm disablement switch 185 may be positioned on the top surface 113 of the housing 110 such that it cannot be accessed when the powered security apparatus 100 is securing a portable electronic device 10.

Figure 6:
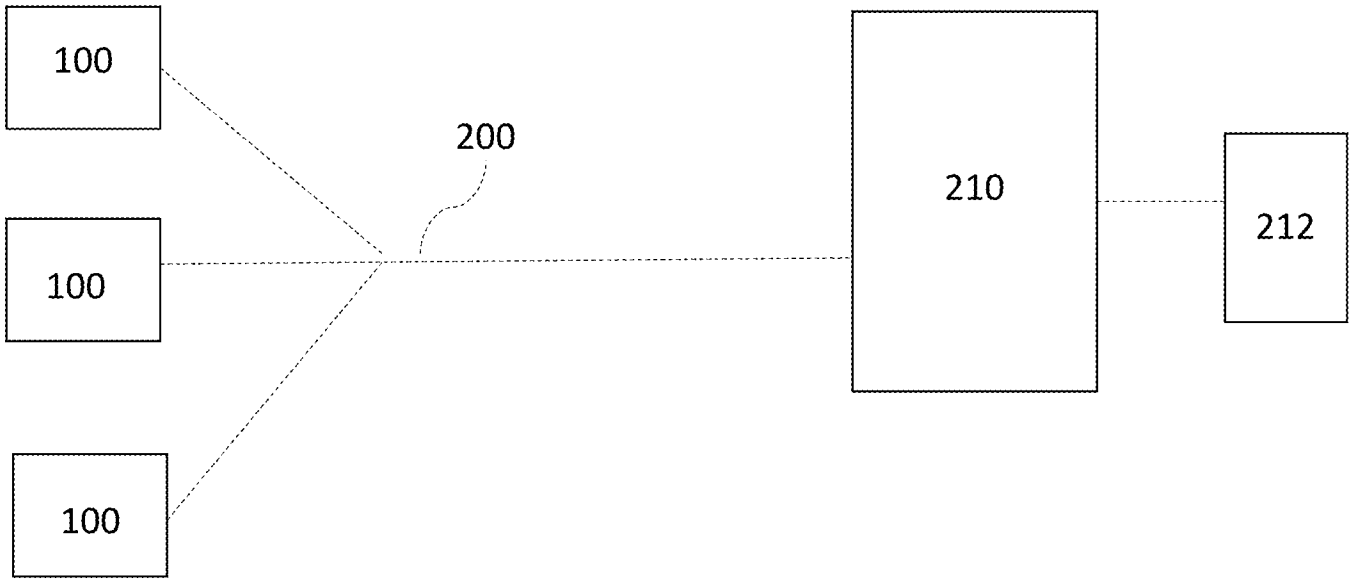
FIG. 6 illustrates a schematic diagram of a security system comprising a plurality of powered security apparatuses.

An authorized input may be provided to the input interface at any time. For example, if an authorized input is provided when the powered security apparatus 100 is in the open position, then the actuator 150 will be signaled to drive the driver 146 such that the holders 130 move towards each other. While this process is occurring, an authorized input may be provided again at the input interface which may act to stop the driving process. At this point, the driving process may be reversed automatically or upon again providing an authorized input to the input interface. Alternatively, the driving process may resume by providing an authorized input to the input interface. Referring to FIG. 6, the powered security apparatus 100 may be configured to be connected to a network 200 and communicate with a central server or central control unit 210. In this manner, an authorized input a the input interface may be recognized by the central control unit 210, which in turn provides a signal leading to the operation of the actuator 150. The central control unit 210 may further comprise a central monitoring unit 212 that may be configured to enable a single authorized user to control multiple powered security apparatuses 100 at once or receive information pertaining to multiple powered security apparatuses 100, such as the alarm state, whether a portable electronic device is secured by the powered security apparatus 100, or whether the powered security apparatus 100 is in an open or closed state. The central monitoring unit 212 may also receive signals from the powered security apparatuses 100 indicating a malfunction.

In an embodiment, control of the actuator 150 may be initiated via a mechanical input, such as a key or keypad, rather than an RFID card or a biometric input. The components of the powered security apparatus 100 may be comprised of a metal such as but not limited to steel, nickel, or zinc, or a durable shock resistant plastic, or any combination thereof.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

The invention claimed is:

1. A security apparatus comprising:

a housing comprising a top surface;

a body at least partially positioned within the housing and comprising a first guide and a second guide extending along a guide axis and positioned at opposing sides of the body;

a first holder moveably coupled to the first guide;

a second holder moveably coupled to the second guide;

a third guide extending from the body and intersecting the guide axis, wherein the third guide comprises a plurality of surface features;

a support moveably coupled to the third guide and including a lock assembly, wherein in a locked state, the support is enabled to move in a first direction along the third guide, and wherein in an unlocked state, the support is further enabled to also move in a second direction along the third guide, wherein the first direction is towards the body and the second direction is away from the body;

an actuator;

at least one driver operatively coupled to the actuator and positioned along the guide axis, wherein the driver is connected to the first holder and the second holder; and a controller in communication with the actuator and comprising a controller input, wherein in response to an authorized input, the actuator is configured to drive the driver to move the first holder along the first guide and to move the second holder along the second guide.

2. The security apparatus of claim 1, further comprising at least one sensor positioned on the top surface of the housing.

3. The security apparatus of claim 2, further comprising an alarm in communication with the at least one sensor.

4. The security apparatus of claim 1, wherein the controller input is configured to receive one of an RFID card, a Bluetooth® key, and a biometric input.

5. The security apparatus of claim 1, further comprising one or more anti-skid pads positioned on the top surface of the housing.

6. The security apparatus of claim 1, further comprising an alarm disablement device.

7. A security apparatus comprising:

a body comprising a first guide and a second guide extending along a guide axis and positioned at opposing side of the body;

a first holder moveably coupled to the first guide;

a second holder moveably coupled to the second guide;

an actuator;

at least one driver operatively coupled to the actuator and positioned along the guide axis, wherein the driver is connected to the first holder and the second holder; and a controller in communication with the actuator and comprising a controller input, wherein in response to an authorized input, the actuator is configured to drive the driver to move the first holder along the first guide and to move the second holder along the second guide.

8. The security apparatus of claim 7, further comprising:

a third guide extending from the body and intersecting the guide axis, wherein the third guide comprises a plurality of surface features; and a support moveably coupled to the third guide and including a lock assembly, wherein in a locked state, the support is enabled to move in a first direction along the third guide, and wherein in an unlocked state, the support is further enabled to also move in a second direction along the third guide, wherein the first direction is towards the body and the second direction is away from the body.

9. The security apparatus of claim 7, further comprising a housing comprising a top surface and configured to at least partially surround the body.

10. The security apparatus of claim 9, further comprising at least one sensor positioned on the top surface of the housing.

11. The security apparatus of claim 10, further comprising an alarm in communication with the at least one sensor.

12. The security apparatus of claim 7, wherein the controller input is configured to receive one of an RFID card, a Bluetooth® key, and a biometric input.

13. The security apparatus of claim 9, further comprising one or more anti-skid pads positioned on the top surface of the housing.

14. The security apparatus of claim 7, further comprising an alarm disablement device.

15. The security apparatus of claim 7, further comprising one or more battery cells in electrical communication with the actuator.

16. A security system for a portable electronic device, the security system comprising:

at least one security apparatus comprising, a body comprising a first guide and a second guide extending along a guide axis and positioned at opposing side of the body, a first holder moveably coupled to the first guide, a second holder moveably coupled to the second guide, an actuator, at least one driver operatively coupled to the actuator and positioned along the guide axis, wherein the driver is connected to the first holder and the second holder, and a controller in communication with the actuator and comprising a controller input, a central control unit positioned away from the at least one security apparatus and in communication with the at least one security apparatus and configured to recognize an authorized input at the controller input, wherein in response to the authorized input, the central control unit is configured to transmit a signal to activate the actuator to drive the driver to move the first holder along the first guide and to move the second holder along the second guide.

* * * * *